US005209678A

United States Patent [19]

Allen et al.

[11] Patent Number: 5,209,678

[45] Date of Patent: May 11, 1993

[54] TELECOMMUNICATIONS FRONT ACCESS COAXIAL JACK AND PLUG ASSEMBLY WITH RELEASABLE LOCKING FEATURE

[75] Inventors: Brian J. Allen, Spokane; Duane B. Kutsch, Otis Orchards, both of Wash.

[73] Assignee: Telect, Inc., Liberty Lake, Wash.

[21] Appl. No.: 818,699

[22] Filed: Jan. 9, 1992

[51] Int. Cl.[5] ..... H01R 13/625

[52] U.S. Cl. ..... 439/672; 439/554; 439/584

[58] Field of Search ..... 439/335, 333, 332, 554, 439/557, 671-673, 584, 585

[56] References Cited

U.S. PATENT DOCUMENTS

| | | | |
|---|---|---|---|
| 2,785,384 | 3/1957 | Wickesser | 439/584 |
| 3,283,287 | 11/1966 | Stark et al. | 439/585 |
| 3,319,211 | 5/1967 | Smith et al. | 439/578 |
| 3,671,922 | 6/1972 | Zerlin et al. | 439/578 |
| 4,037,909 | 7/1977 | Trompeter et al. | 439/584 |
| 4,326,769 | 4/1982 | Dorsey et al. | 439/578 |
| 4,609,242 | 9/1986 | Kemppainen | 439/583 |
| 4,628,159 | 12/1986 | Deitch et al. | 200/51.05 |
| 4,690,481 | 9/1987 | Randolph | 439/585 |
| 4,895,530 | 1/1990 | Gugelmeyer et al. | 439/335 |

*Primary Examiner*—Larry I. Schwartz
*Assistant Examiner*—Hien D. Yu
*Attorney, Agent, or Firm*—Wells, St. John, Roberts, Gregory & Matkin

[57] ABSTRACT

A unique telecommunication coaxial front access jack and plug assembly 50 is illustrated in FIGS. 3 and 4 for mounting on a front panel 52 of telecommunication terminal equipment in which the front panel has a plurality of front panel apertures 94 to receive jacks 56. Each jack 56 has a barrel housing 80 with a front section 82 projecting into an aperture 54. The front section 82 has a locking groove 104 formed therein for receiving bayonet prongs 142 of a plug sleeve 128. The prongs 142 are positioned at a rear section 136 of the sleeve adjacent a resilient "O"-ring 147 that provides locking compression of the bayonet prongs in the locking groove 104 to prevent inadvertent removal of the plug 124 from the jack 56.

8 Claims, 4 Drawing Sheets

TELECOMMUNICATIONS FRONT ACCESS COAXIAL JACK AND PLUG ASSEMBLY WITH RELEASABLE LOCKING FEATURE

TECHNICAL FIELD

This invention relates to telecommunication front access coaxial jack and plug assemblies and more particularly to such assemblies having interlock features.

BACKGROUND OF THE INVENTION

One of the principal objects of telecommunication cross-connect jack panels is to provide front access to telecommunication circuits for temporary rerouting, repairing, and circuit monitoring. Generally, such rerouting, monitoring, and repairing functions are accomplished utilizing a coaxial patch cord that is temporarily inserted into a front access cross-connect jack on the front panel of the telecommunication terminal equipment.

One of the problems that occasionally occurred was the ease with which a coaxial plug of the patch cable could be dislodged from the front panel by vibration or inadvertent engagement by a telecommunication worker while passing by or while working on adjacent circuits.

One of the prior art solutions to such a problem is illustrated in FIGS. 1 and 2. A telecommunication cross-connect module 10 having a front panel 12 with a plurality of front access apertures 14 is illustrated in FIG. 1. The module 10 has a back panel 16 that has bayonet-type rear coaxial connectors 18. The bayonet-type rear coaxial connectors 18 are illustrated in FIG. 1. The module 10 includes jacks 20 that may be specifically identified as IN jack 20*a*, OUT jack 20*b*, OUT CROSS-CONNECT jack 20*c*, IN CROSS-CONNECT jack 20*d*, and MONITOR jack 20*e*.

A standard plug 22 of a patch cable is illustrated in FIG. 2 in which the plug has a general body 24 with a sleeve 26 that is inserted into one of the jacks 20. The body 24 has a front shoulder 28 that engages a front face of a selected jack 20 in which the front face is flush with the front panel 12. The standard plug 22 has a rear shoulder 30 with a coaxial patch cable 32 extending therefrom.

The standard plug 22 is releasably held in the jack by releasable locking means generally identified with the numeral 36. Specifically, the locking means 36 of the prior art included a retainer spring clip 38 that is mounted to the front panel adjacent the front access apertures 14. Retainer spring clips 38 each include a bent shoulder element 42 and a tab 44. The bent shoulder element 42 is designed to engage the rear shoulder 30 of the plug 22 to hold the plug in the selected jack 20. The finger tab 44 enables the operator to push the bent shoulder element 42 from the rear shoulder 30 to enable the plug 22 to be intentionally removed from the selected jack 20. However, the retainer spring clip 38 normally securely holds and releasably locks the plug in the jack 20 to prevent inadvertent disengagement of the plug 22 from the selected jack 20.

Although the retainer spring clip 38 is reasonably effective, it projects from the front panel 12 enabling it to be easily damaged over time, and bent out of position. It is relatively easy for the clip to snag the garment of a telecommunication worker. Furthermore, the clip 38 gets in the way of easy insertion of the plug in adjacent modules.

Thus, one of the objectives of the invention is to provide a telecommunication jack and plug assembly with a releasable locking means that overcomes many of the problems associated with the retainer spring clip 38 which is presently fairly widely used.

These and other objects and advantages of this invention will become apparent upon reading the following detailed description of a preferred embodiment.

BRIEF DESCRIPTION OF THE DRAWINGS

Preferred embodiments of the invention are described below with reference to the accompanying drawings, which are briefly described below.

FIGS. 8–10 are a sequence of vertical cross-sectional views of the special plug and jack in which FIG. 8 illustrates the initial insertion of the plug into the jack; FIG. 9 illustrates insertion of the jack to interconnect the coaxial electrically conductive elements and to ground a sleeve of the jack; and FIG. 10 illustrates full insertion and twisting of the plug to releasably lock the plug to the jack.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 2:
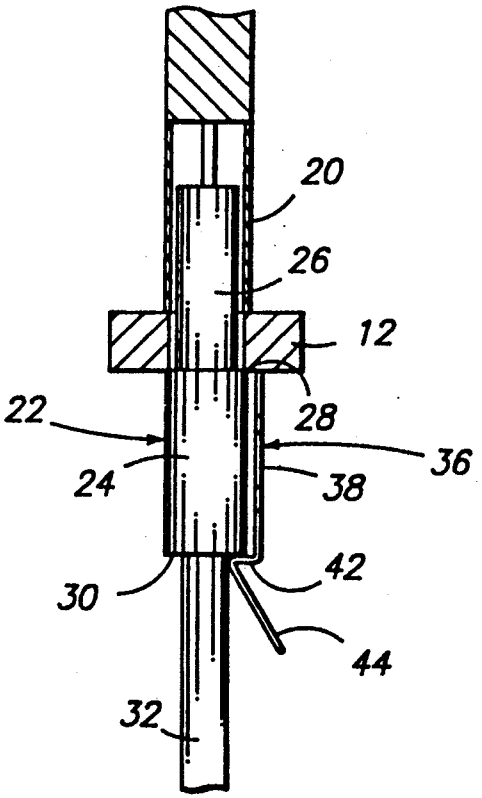
FIG 2 PRIOR ART
FIG. 2 is a horizontal cross-sectional view taken along line 2—2 in FIG. 1 illustrating the retainer spring clip 38.
Figure 1:
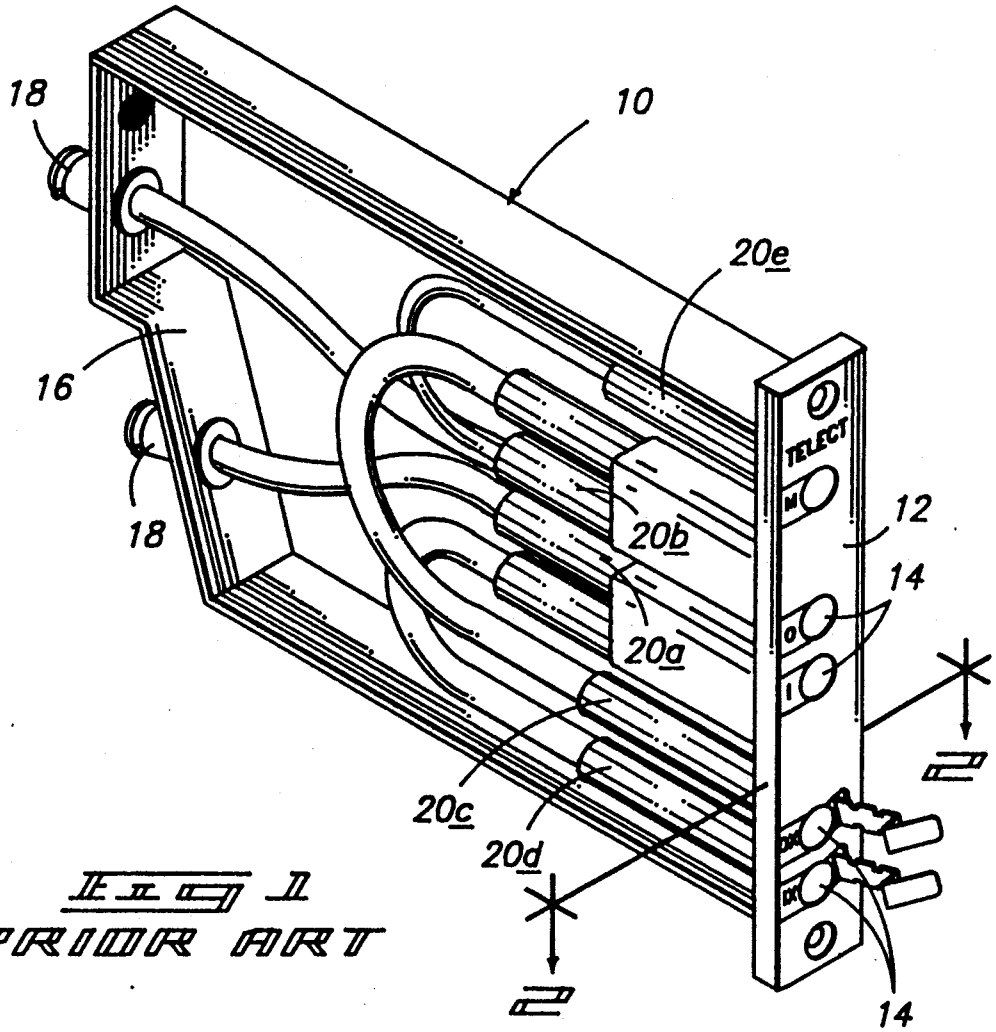
FIG 1 PRIOR ART
FIG. 1 is an isometric view of a telecommunication cross-connect jack module of the prior art.
Figure 3:
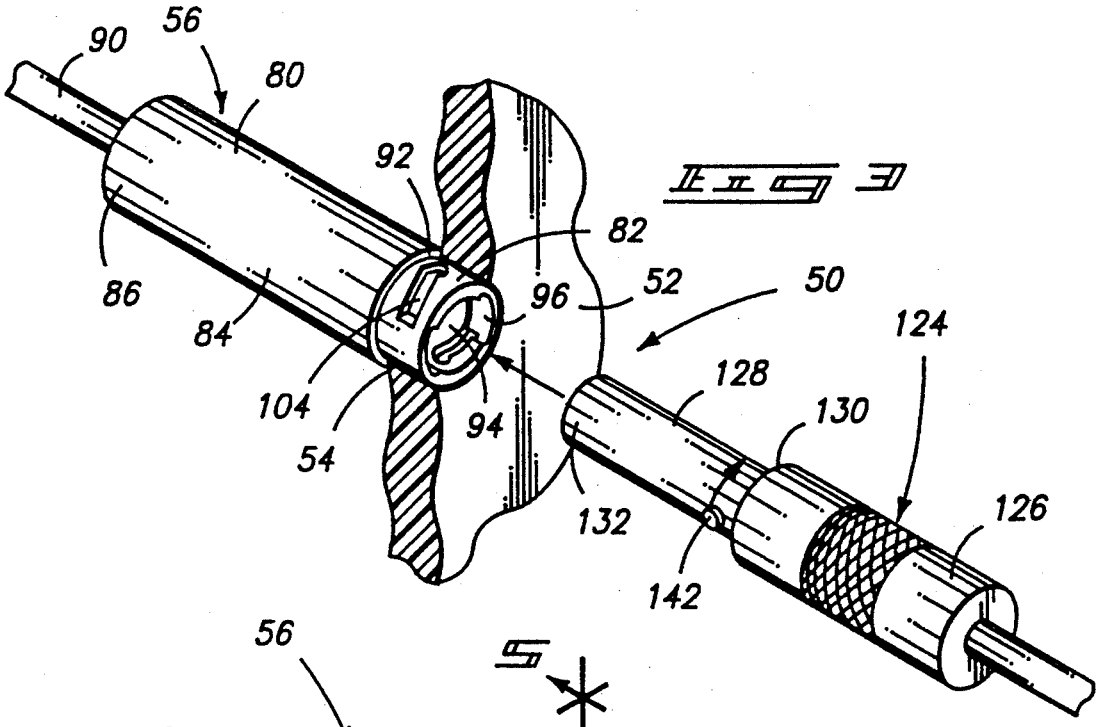
FIG. 3 is an isometric view of a preferred embodiment of the present invention illustrating a telecommunication jack and plug assembly having a releasable locking feature in which a special plug is illustrated prior to being inserted into a special jack at the front panel of the telecommunication terminal equipment.
Figure 4:
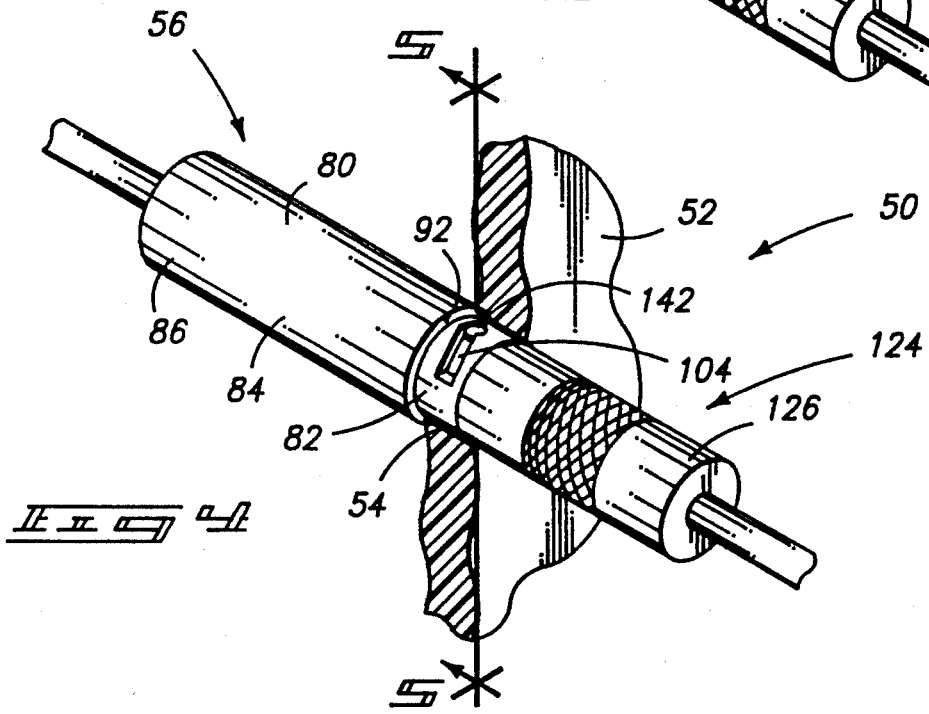
FIG. 4 is an isometric view similar to FIG. 3 except showing the special plug inserted and locked into position with the special jack to prevent the plug from being advertently removed from the front panel.
Figure 5:
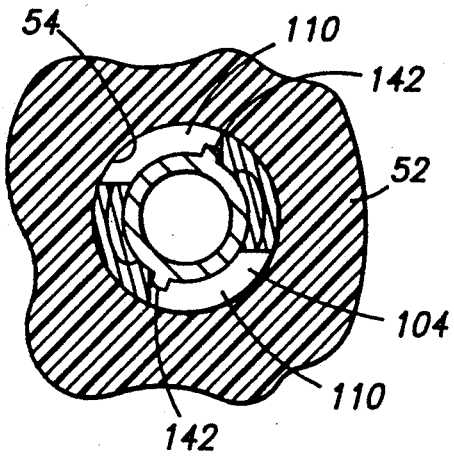
FIG. 5 is a vertical cross-sectional view taken along line 5—5 showing in more detail a releasable locking means.

Referring now in detail to the drawings, there is illustrated in FIGS. 3 and 4 a telecommunication coaxial front access jack and plug assembly, generally designated with the numeral 50. The assembly 50 is mounted in a front panel 52 of telecommunication terminal equipment. The front panel 52 has a plurality of front panel apertures 54 for receiving jacks and enabling plugs to be inserted into such jacks.

A representative coaxial jack 56 is illustrated having a housing in the form of a barrel 80. The barrel 80 has a front section 82, an intermediate section 84 and a rear section 86. In this particular embodiment, a coaxial cable 90 extends from the rear section 86 for connecting to a rear connector at a rear panel (not shown). The barrel 80 has a indented peripheral shoulder 92 that identifies the demarcation between the front section 82 and the intermediate section 84. The shoulder 92 engages the rear of the front panel 52 with the front section 82 mounted in the aperture 54. The front section 82 has a front face that is flush with the front panel 52.

Figure 8B:
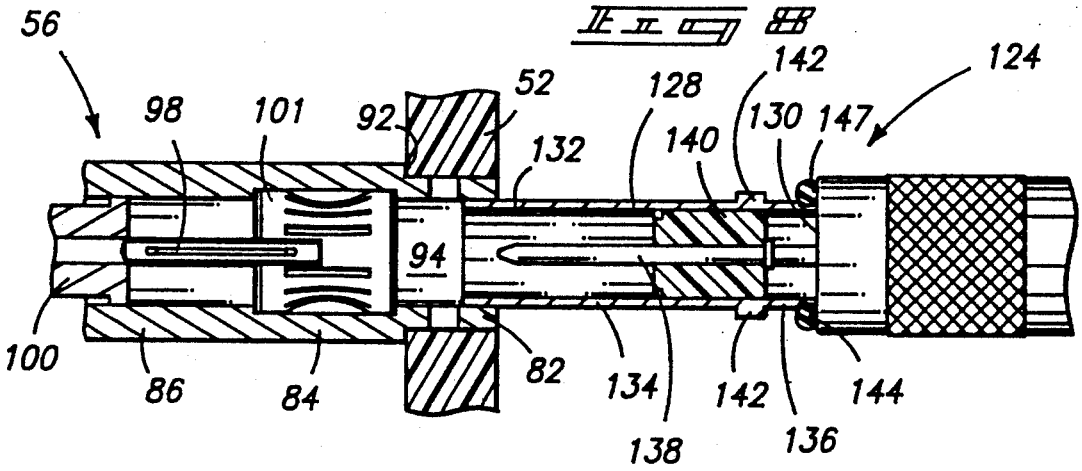
Figure 9:
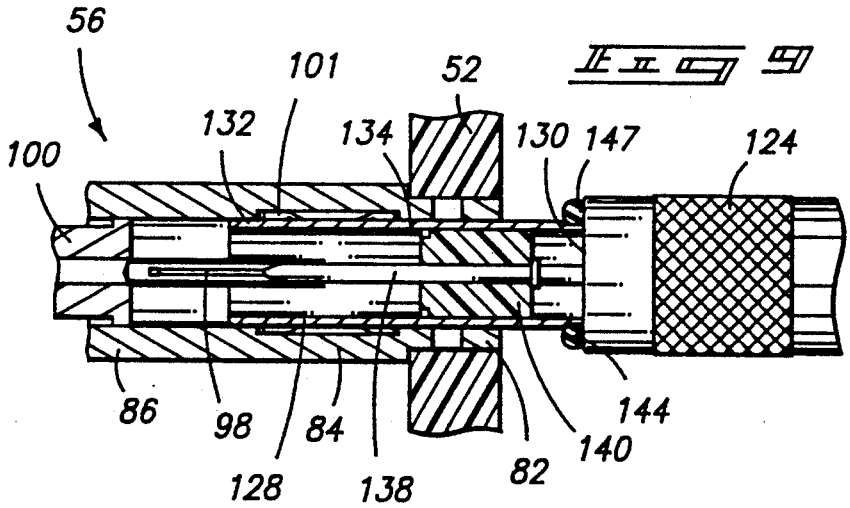
Figure 10:
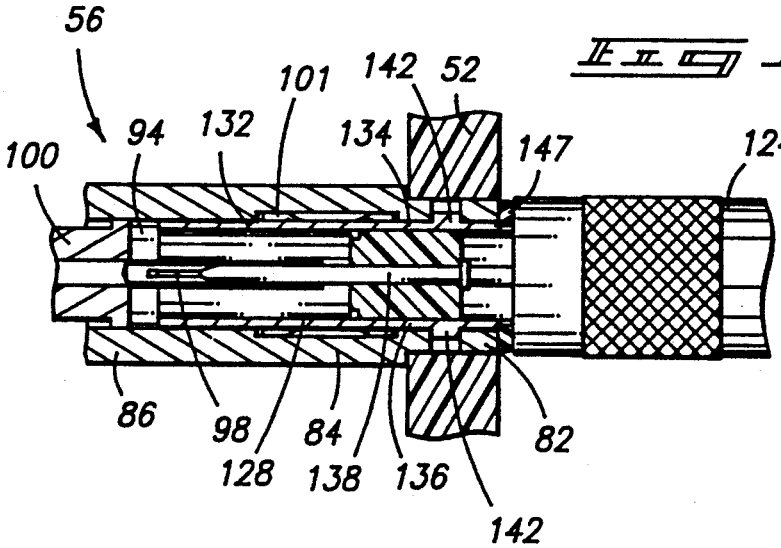

The barrel 80 includes a cylindrical cavity 94 that extends rearward from a front opening 96 through the front section 82 and intermediate section 84 and into the rear section 86 as illustrated in FIGS. 8–10. The cylindrical cavity 94 has a peripheral generally cylindrical cavity wall 95 that has a barrel axis.

The jack 56 includes a female coaxial connector element 98 that is supported coaxially within the cylindrical cavity 94 by a support element 100 that is mounted in the rear section 86. The female coaxial connector element 98 extends forward from the rear section 86 into the intermediate section 84.

The jack 56 further includes a grounding peripheral spring 101 mounted in an indentation in the cylindrical cavity 94. The grounding peripheral spring 101 is mounted in the intermediate section 84 generally coaxial to the female coaxial connector element 98.

The barrel 80 has a locking groove 104 (FIGS. 3–7) formed in the front section 82. The locking groove 104 preferably has a bayonet-type configuration having longitudinal groove sections 106 that communicate with the front opening 96 and extend rearward in the front section 82. The longitudinal groove sections 106 are diametrically opposed to each other (FIG. 7).

Figure 6:
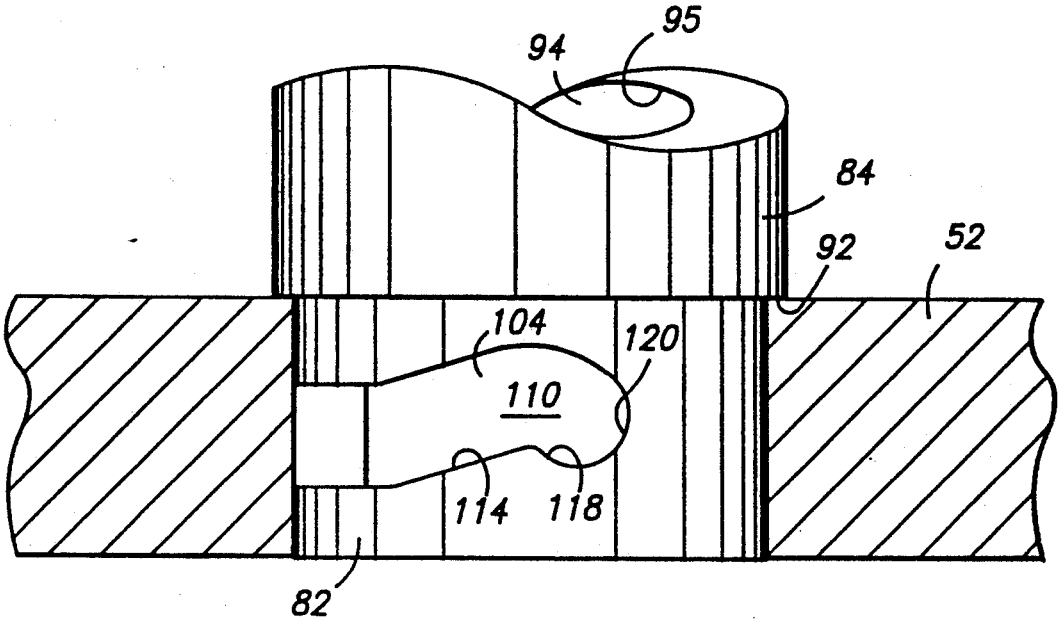
FIG. 6 is an isometric top view of a forward portion of a jack illustrating a portion of the releasable locking means.
Figure 7:
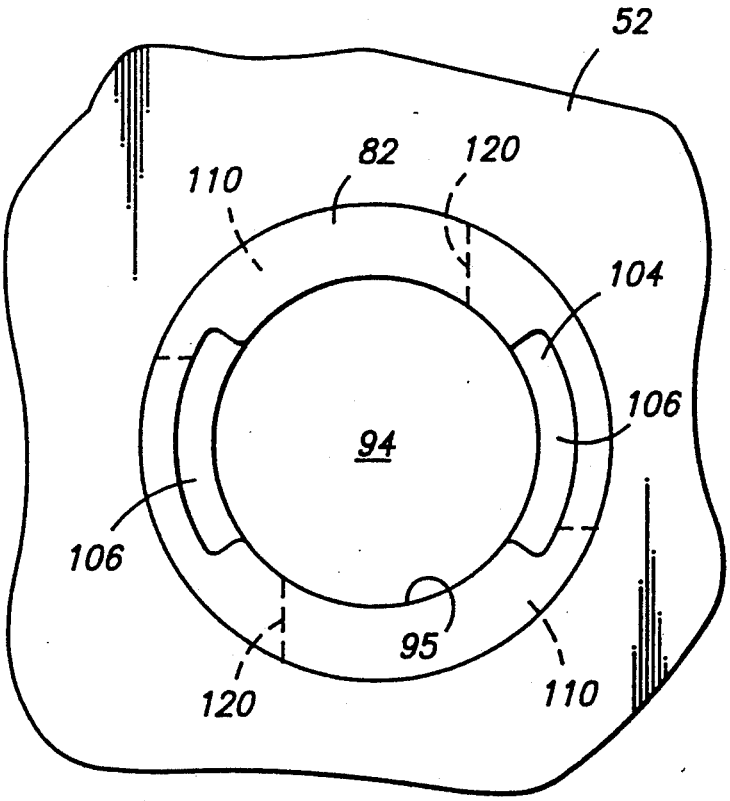
FIG. 7 is a front view of the forward portion of the jack as illustrated in FIG. 6.

The locking groove 104 includes circumferential or lateral groove sections 110 that communicate with the longitudinal groove sections 106 as illustrated in FIGS. 6 and 7. The lateral groove sections 110 include a rearward inclined portion having an inclined shoulder surface 114 that extends laterally and slightly inward. The circumferential groove sections 110 further include a forward inclined portion communicating with the rearward inclined portion 112 providing a locking shoulder 118 and a groove end wall 120.

The assembly 50 includes a plug 124 having a body 126. The body 126 includes a forward projecting sleeve 128 for inserting into the cylindrical cavity 94 of the jack 56. The body 126 has a forward shoulder 130 of an enlarged diameter with respect to the sleeve 128. The sleeve 128 has a forward section 132 for projecting into the rear section 86 of the jack 56 and an intermediate section 134 for extending into the intermediate section 84 of the jack 56 and a rear section 136 for extending into the front section 82 of the jack 56.

The plug 124 has a coaxial male electrical connector element 138 that is mounted coaxially by a support means 140 and the rear section 136 in which the male element 138 projects forward into the intermediate section 138 as illustrated in FIGS. 8–10.

The sleeve 128 includes bayonet prongs 142 formed thereon diametrically opposed to each other for projecting into the bayonet locking grooves 104. The sleeve 128 includes a peripheral groove 144 formed thereon adjacent the forward shoulder 130 for receiving a resilient element such as a compressible "O"-ring 147.

The operation of the assembly 50 is illustrated in FIGS. 8–10 for releasably locking the plug 124 to the jack 56 to prevent inadvertent dislodgement or removal of the plug 124 from the jack 56, causing electrical disconnection of the male coaxial electrical connector element 138 with the female electrical coaxial connector element 98. FIG. 8 illustrates the initial insertion of the plug 124 into the jack 56 with the forward section 132 inserted through the front opening 96 and into the forward section 82. At this point, the male coaxial electrical connector element 138 is spaced from and does not provide electrical continuity with the female coaxial connector element 98.

FIG. 9 illustrates further insertion of the sleeve 128 into the cylindrical cavity 94 with the male coaxial electrical connector element 138 engaging and providing electrical continuity. It should be noted that the forward section 132 of the sleeve 128 engages the grounding peripheral spring 101 to electrically ground the plug 124 and provide the necessary shielding.

FIG. 10 illustrates full insertion of the sleeve 128 and the rotation of the plug sleeve 128 relative to the barrel 80 to releasably lock the plug 124 to the jack 56. More specifically, the bayonet prongs 142 initially enter the longitudinal groove sections 106 and proceed along the groove sections 106 to the circumferential or peripheral groove sections 110. At this point, the plug 124 is rotated with the prongs 142 frictionally sliding along the inclined surface 114 and then along the locking shoulder 118 to the groove end wall 120. At this point, the bayonet prongs 142 reside in a lock position as illustrated in FIG. 4. It should be noted, as illustrated in FIG. 10, that the resilient element 124, upon full insertion, engages the front surface of the front section 82 of the barrel 80 and compresses as the prongs 142 move along the shoulder surface 114. The compression is somewhat released when the prongs 142 move along the locking shoulder 118 to the locking position illustrated in FIG. 4.

In this manner, there is no clip or projection that extends outward from the front panel that would interfere with a telecommunication worker's clothing or interface with insertion of plugs in adjacent front panel jacks. It should be specifically noted that the locking groove 104 is formed in the forward section 82 of the barrel 80 forward of the shoulder 92 to receive the bayonet prongs 142 that are positioned at the rear section 138 of the sleeve 128 adjacent the forward shoulder 130.

In compliance with the statute, the invention has been described in language more or less specific as to methodical features. It is to be understood, however, that the invention is not limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A telecommunication front access cross connect jack module and plug assembly, comprising:

a front panel having a plurality of front access apertures;

a rear panel having a plurality of rear coaxial connectors;

a plurality of coaxial jacks aligned with corresponding front panel access apertures;

each of the coaxial jacks having a jack housing with an elongated barrel comprising (1) a forward barrel section projecting into a corresponding front panel access apertures, (2) an intermediate barrel section rearward of the front panel, and (3) a rear barrel section rearward of the front panel;

said forward barrel section having a front surface substantially flush with the front panel access aperture;

said jack housing barrel having an elongated plug receiving cylindrical cavity formed therein extending along a cavity axis from a front access opening formed in the forward barrel section rearward through the intermediate barrel section and into the rear barrel section;

each of the coaxial jacks having a female electrically conductive connector element mounted coaxially in the cylindrical cavity at the rear barrel section;

each of the coaxial jacks having a plug grounding element projecting into the cylindrical cavity at the intermediate barrel section;

said forward barrel section having a releasable bayonet locking groove formed therein communicating with the cylindrical cavity forward of the intermediate barrel section;

a coaxial plug having a plug housing with a projecting elongated sleeve for insertion into the plug receiving cylindrical cavity of the barrel;

said coaxial plug having a male electrically conductive connector element coaxially mounted in the sleeve for mating with the female coaxial connector element of the jack when the sleeve is fully inserted into the barrel cavity;

said plug sleeve having (1) a rear sleeve section for projecting into the forward section of the jack housing, (2) an intermediate sleeve section for projecting into the intermediate jack housing section and engaging the grounding element to electrically ground the sleeve, and (3) a forward sleeve section for projecting into the rear jack housing section with the male connector element mating with the female connector element to transmit telecommunication electrical signals; and said rear sleeve section having a bayonet prong formed thereon for projecting into the bayonet groove of the forward barrel section to releasable secure the plug to the front panel to prevent unintentional release of the plug from the front panel.

2. The telecommunication front access coaxial jack module and plug assembly of claim 1 wherein the jack barrel has a shoulder between the forward barrel section and the intermediate barrel section engaging the front panel.

3. The telecommunication front access cross connect jack module and plug assembly as defined in claim 1 wherein the forward barrel section has a front surface surrounding the front access opening and wherein the releasable bayonet locking groove is formed in the front surface and extends initially longitudinal rearward and then circumferentially to a lateral lock position with respect to the cavity axis within the forward barrel section.

4. The telecommunication front access coaxial module and plug assembly as defined in claim 3 wherein the plug has a resilient element for engaging the front surface of the forward barrel section when the sleeve is fully inserted into the barrel cavity to resiliently secure the plug prong in the lateral lock position.

5. The telecommunication front access coaxial jack module and plug assembly as defined in claim 1 wherein the forward barrel section has a front surface surrounding the front access opening and wherein the releasable bayonet locking groove has (1) a longitudinal groove section that is formed in front surface and extends longitudinally rearward along the cavity axis in the forward barrel section to receive and guide the plug sleeve prong rearward for full insertion into the barrel cavity and (2) a circumferential groove section rearwardly spaced from the front surface and extending circumferentially about the cavity axis for enabling the fully inserted sleeve to be rotated in the barrel cavity with the sleeve prong sliding along a lateral shoulder formed in the forward barrel section by the circumferential groove section.

6. The telecommunication front access coaxial jack module and plug assembly as defined in claim 5 therein the circumferential groove section has an first section that extends circumferentially about the cavity axis at an incline rearward angle to the cavity axis forming the lateral shoulder and a second section that extends circumferentially about the cavity axis at an inclined forward angle to the cavity axis forming a locking shoulder for enabling the fully inserted sleeve to be rotated in the barrel cavity with the sleeve prong first sliding along the lateral shoulder and then along the locking shoulder.

7. The telecommunication front access coaxial jack module and plug assembly as defined in claim 6 wherein the plug includes a compressible resilient element adjacent the rear section of the sleeve for engaging the front surface of the forward section of the barrel and being compressed when the sleeve is being rotated with the sleeve prong sliding along the lateral groove and then being expanded when the sleeve is being rotated with the sleeve prong sliding along the locking shouldering to releasable lock the plug to the front panel.

8. The telecommunication front access coaxial jack module and plug assembly as defined in claim 7 wherein the plug has enlarged shoulder adjacent the rear section of the sleeve and wherein the compressible resilient element comprises a compressible O-ring mounted on the rear section of the sleeve and engaging the enlarged shoulder for being compressed against the front surface of the forward section of the jack barrel.

* * * * *